US011705266B2

(12) United States Patent
Rottner

(10) Patent No.: US 11,705,266 B2
(45) Date of Patent: Jul. 18, 2023

(54) CORE COMPONENT

(71) Applicant: TDK Electronics AG, Munich (DE)

(72) Inventor: Michael Rottner, Unterhaching (DE)

(73) Assignee: TDK ELECTRONICS AG, Munich (DE)

( * ) Notice: Subject to any disclaimer, the term of this patent is extended or adjusted under 35 U.S.C. 154(b) by 388 days.

(21) Appl. No.: 17/023,124

(22) Filed: Sep. 16, 2020

(65) Prior Publication Data

US 2021/0098179 A1 Apr. 1, 2021

(30) Foreign Application Priority Data

Oct. 1, 2019 (DE) ..... 102019126518.5

(51) Int. Cl.

| | |
|---|---|
| ***H01F 27/26*** | (2006.01) |
| ***H01F 17/04*** | (2006.01) |
| ***H01F 3/08*** | (2006.01) |
| *H01F 27/29* | (2006.01) |

(52) U.S. Cl.

CPC ..... *H01F 27/263* (2013.01); *H01F 3/08* (2013.01); *H01F 17/04* (2013.01); *H01F 27/292* (2013.01)

(58) Field of Classification Search

CPC ..... H01F 27/263; H01F 3/08; H01F 17/04; H01F 27/292

See application file for complete search history.

(56) References Cited

U.S. PATENT DOCUMENTS

| | | | | |
|---|---|---|---|---|
| 4,424,504 A * | 1/1984 | Mitsui | H01F 27/255 336/83 |
| 7,061,358 B1 * | 6/2006 | Yang | H01F 17/043 336/198 |
| 2002/0017971 A1 * | 2/2002 | Koyama | H01F 17/043 336/83 |

FOREIGN PATENT DOCUMENTS

| | | | |
|---|---|---|---|
| CN | 104505223 A | * | 4/2015 |
| DE | 1155859 B | | 10/1963 |
| DE | 202006015611 U1 | | 2/2008 |

* cited by examiner

*Primary Examiner* — Tuyen T Nguyen
(74) *Attorney, Agent, or Firm* — Slater Matsil, LLP

(57) ABSTRACT

In an embodiment a core component includes a base plate, a plurality of members arranged on corners of the base plate and delimiting an inner region of the core component and a center piece located in the inner region and having an oval basic shape.

11 Claims, 1 Drawing Sheet

CORE COMPONENT

CROSS-REFERENCE TO RELATED APPLICATIONS

This application claims priority to German Patent Application No. 102019126518.5, filed on Oct. 1, 2019, which application is hereby incorporated herein by reference.

TECHNICAL FIELD

The present invention relates to a core component for an inductive structural element. The core component may, for example, be used in a throttle or a transformer.

BACKGROUND

There are known conventional core components such as RM8 or RM10 cores which have a winding space, in which a winding wire is wound around a round centre lug.

SUMMARY

Embodiments provide an improved core component. The improved core component may, for example, have a smaller power loss than conventional components and/or improved shielding with respect to EMC (electromagnetic compatibility) behavior than conventional components.

According to one embodiment, a core component is set out. The core component is, for example, constructed behavior as a ferrite core. For example, the core component is sintered. The core component is used as an inductivity.

The core component preferably has a structural form based on an X core. The core component has in particular a square basic shape. The core component has a base plate or a base face. The base plate or the base face of the core component has a spatial requirement which corresponds to that of a conventional core component, in particular of an RM8 core. The base plate forms a base of the core component. The base plate is constructed to be square. Preferably, an edge length of the base plate measures more than 18 mm and less than 25 mm, for example, 20 mm or 19 mm, preferably 19.3 mm.

The core component further has a plurality of members. In particular, the core component has four members. Preferably, the members are formed at corners of the base plate. The base plate preferably has four corners. A member is preferably formed around each corner of the base plate. Preferably, the member and the base plate are constructed in an integral manner. The respective member preferably has the basic shape of a triangle.

The members are constructed to delimit an inner region of the core component in an outward direction. Preferably, the members form a winding space of the core component. A winding space is intended to be understood to be the space in the inner region of the core component in which a winding is introduced. The members are constructed and arranged to shield the winding arranged in the core component in an outward direction.

The core component further has a centre piece. The centre piece is formed in the inner region. The centre piece and base plate are preferably constructed in an integral manner. The centre piece delimits the winding space of the core component in an inward direction. The centre piece is constructed and arranged in such a manner that a winding wire which is arranged on a coil member can be introduced around the centre piece into the winding space. The centre piece has a smooth surface. The centre piece has an oval or elliptical basic shape.

The above-described core component uses the space predetermined by a conventional RM8 core in an optimum manner. As a result of the use of the structural form on the basis of an X core with an oval centre piece, a standard RM8 core which is equivalent in terms of spatial requirement is consequently replaced. As a result, the power loss is considerably reduced since the new structural shape has a significantly larger effective magnetic cross-section. A conventional RM8 core thus has a minimum effective cross-section Ae(min)=55 $mm^2$. The core component described above has in contrast a significantly larger minimum effective cross-section of Ae(min)=72 $mm^2$.

In addition, the new structural shape with an oval centre piece and the members which are formed around the corners of the base plate forms a larger winding space. The winding space of a conventional RM8 core thus has a surface-area F of F=48.95 $mm^2$. The winding space of the above-described core component has in contrast a surface-area F of F=55.2 $mm^2$. The space available is consequently used in an optimal manner.

Furthermore, the outer shape of the X core geometry provides better shielding with respect to EMC behavior than conventional RM8 cores. In particular, the winding introduced in the core component is surrounded in an optimum manner by the members, which leads to an optimized EMC behavior. This is further optimized by the square basic shape of the core component.

In one embodiment, the inner region of the core component is constructed in an oval manner. In particular, the members are constructed in such a manner that the region inside the core component and consequently also the winding space has an oval basic shape. Consequently, the base face predetermined by an RM8 core is used in an optimal manner. The winding space available in comparison with a conventional core component is increased.

In one embodiment, the respective member has an inner face. The inner face faces the centre piece. The region between the inner face and centre piece forms the winding space of the core component. The inner face is constructed to be rounded. This leads to an increase of the effective magnetic cross-section of the core component in comparison with conventional core components. The winding space available is used in an optimal manner. Furthermore, as a result of the rounded shape, the introduction of a coil member with the winding is facilitated.

In one embodiment, the inner face is delimited by two longitudinal edges of the member. The longitudinal edges extend from the base plate in a vertical direction. The longitudinal edges are constructed to be rounded. A rounding of the respective longitudinal edge has a radius greater than 4 mm and less than 6 mm. Preferably, the radius of the rounding is 5 mm. As a result of the specific construction of the members, the geometry of the core component in comparison with conventional core components can be optimized and the power loss can be reduced.

In one embodiment, the respective member is formed in an asymmetrical manner around the respective corner of the base plate. In particular, the respective member has two outer faces, which have a different horizontal extent (extension along the base plate). Consequently, the geometry of the core component is further optimized and optimum use is made of the space available.

In one embodiment, the core component has a plurality of openings. The core component preferably has two first openings. The core component further has two second openings. The first openings and the second openings are arranged opposite each other around the base plate.

An opening extends in each case from the base plate in a vertical direction as far as an upper side of the core component. The respective first opening extends in a horizontal direction parallel with a longitudinal axis of the centre piece. The respective second opening extends in a horizontal direction parallel with a transverse axis of the centre piece.

The first openings have a smaller extent in a horizontal direction than the second openings. One opening is constructed in each case between two members. Via the openings and in particular the second openings, the introduction and leading-out of connections are enabled. The first openings serve to stabilize the core component and/or facilitate the production thereof.

In one embodiment, the base plate has at least one recess. Preferably, the base plate has two recesses. The recesses are arranged opposite each other. The recess is formed at the location of the second opening in the base plate. The recess has an opening angle. The opening angle is greater than 35 and less than 40°, preferably 38°, in a particularly preferred manner 38.78°. The recess serves to secure the core component to a printed circuit board.

BRIEF DESCRIPTION OF THE DRAWINGS

The drawings described below are not intended to be understood to be true to scale. Instead, for better illustration, individual dimensions may be illustrated in an enlarged, reduced or also distorted manner.

Elements which are identical to each other or which perform the same function are given the same reference numerals.

In the drawings:

FIG. 1 is a perspective view of a core component;

FIG. 2 is a side view of the core component according to FIG. 1;

FIG. 3 is another side view of the core component according to FIG. 1; and FIG. 4 is a plan view of the core component according to FIG. 1.

DETAILED DESCRIPTION OF ILLUSTRATIVE EMBODIMENTS

Figure 1:
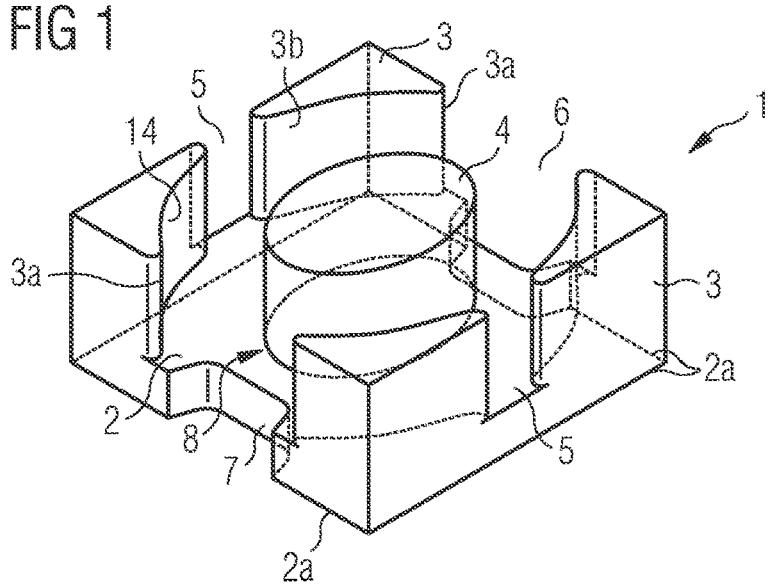
Figure 2:
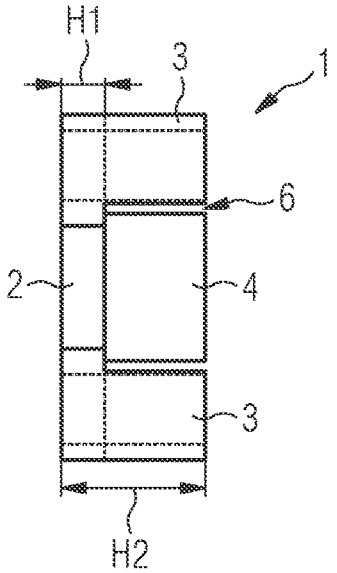
Figure 3:
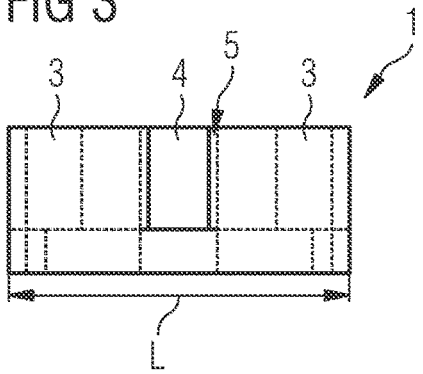

FIGS. 1 to 4 show a core component 1. Preferably, the core component 1 is constructed as a ferrite core. For example, the core component 1 is sintered. The core component 1 is used as an inductivity. The core component 1 may cooperate with another core component. The core component 1 is constructed as a coil core. A winding wire is preferably introduced in the core component 1 (not explicitly illustrated). Preferably, the winding core is wound on a coil member, which is introduced into the core component 1 (not explicitly illustrated). Wires or connections can be guided out of the present core component 1 and electrically connected. The core component 1 is preferably mounted in a printed circuit board.

The core component 1 has a structural shape based on an X core. The core component 1 has a square basic shape. For example, the core component 1 has an outer dimension (length and width) in the range from 15 mm to 25 mm. Preferably, the core component 1 has in each case a length and a width between 18 mm and 20 mm, for example, 19 mm, preferably 19.3 mm. Preferably, the length and width of the core component 1 are identical (square basic shape).

Preferably, the core component 1 has a height H2 (vertical extent, see in this regard FIG. 2) of less than 10 mm. For example, the core component 1 has a height H2 of 9 mm, 8.5 mm, 8 mm or preferably 8.25 mm. Consequently, a very compact core component 1 is provided which is particularly suitable for AC/DC applications and DC/DC applications with the requirement for a very high packing density. The core component 1 has a spatial requirement, which corresponds to that of an equivalent conventional RM8 core.

The core component 1 has a base face or base plate 2. The base plate 2 forms a base or a lower side of the core component 1. The core component 1 has the external shape of a square. In particular, the base plate 2 is constructed to be square. In other words, the base plate 2 has four edges 2*a*, wherein the edges 2*a* each have the same length (edge length L, see FIGS. 3 and 4). Preferably, the edge length L of the respective edge 2*a* is less than 25 mm, for example, 20 mm. Preferably, the edge length L of the edges 2*a* is 19.3 mm.

Preferably, the base plate 2 has a height H1 (vertical extent, see in this regard FIG. 2) of less than 3 mm. For example, the base plate 2 has a height H2 of 2.5 mm.

The core component 1 further has four members 3. The members 3 are in each case formed around one of the four corners of the base plate 2. The members 3 surround the winding arranged in the core component 1 (not explicitly illustrated). The member 3 and the base plate 2 are preferably constructed in an integral manner. The respective member 3 has the basic shape of a triangle. In particular, the respective member 3 has three corners, of which two corners have a rounded shape, as will be described in detail below.

Figure 4:
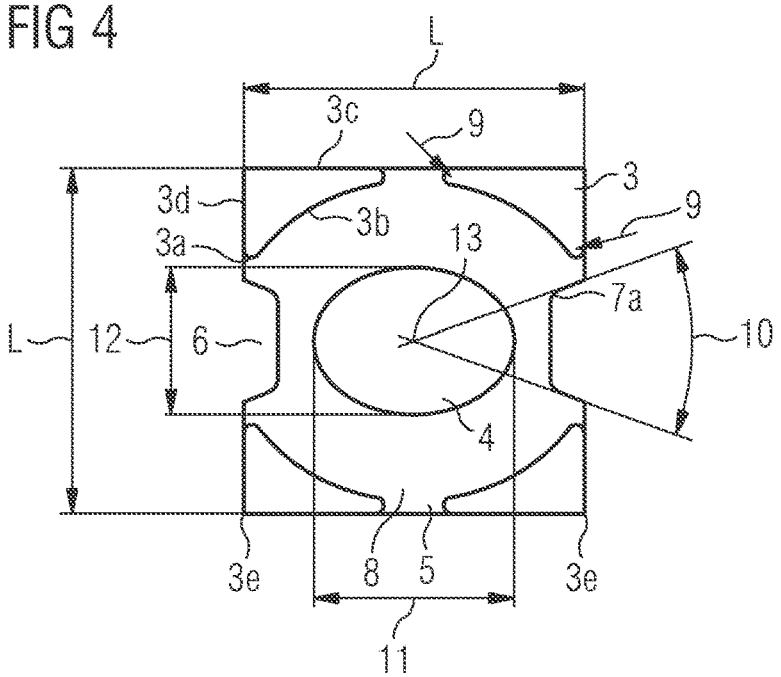

Each member 3 has a first outer face 3*c* and a second outer face 3*d* (see FIGS. 1 and 4). These outer faces 3*c*, 3*d* delimit the core component 1 in an outward direction. The outer faces 3*c*, 3*d* meet in a vertically extending outer edge 3*e* (FIG. 4) of the respective member 3. The outer edge 3*e* is constructed to be pointed or non-curved. The first and second outer faces 3*c*, 3*d* are of the same height and thus have the same extent in a vertical direction or in a direction perpendicular to the base plate 2.

The first and the second outer faces 3*c*, 3*d* are of different lengths. That is to say, the first and second outer faces 3*c*, 3*d* have different extents in a horizontal direction, that is to say, in a direction parallel with the base plate 2. In particular, the first outer face 3*c* has a larger extent along an edge 2*a* of the base plate 2 (horizontal extent) than the second outer face 3*d*. The respective member 3 is consequently formed in an asymmetrical manner around the respective corner of the base plate 2. For example, the ratio of the horizontal edge dimensions of the first outer face 3*c* and second outer face 3*d* is greater than 1.0 and less than or equal to 2.0, preferably 1.5.

The respective member 3 has an inner face 3*b*. The inner face 3*b* delimits an inner region 8 of the core component 1. The inner face 3*b* is delimited towards the sides by two longitudinal edges 3*a* or vertical edges of the member 3. These longitudinal edges 3*a* extend from the base plate 2 in a vertical direction. The respective longitudinal edge 3*a* has a rounded shape. A rounding of the respective longitudinal edge 3*a* has a radius 9 (see FIG. 4) of more than 4 mm and less than 6 mm. Preferably, the rounding has a radius 9 of 5 mm. As a result of the rounding of the longitudinal edges 3*a* and the different length of the outer faces 3*c*, 3*d*, the inner region 8 has an oval shape, as will be explained in greater detail below.

The core component 1 further has openings 5, 6. The core component 1 has two first openings 5 and two second openings 6. The two first openings 5 are arranged opposite each other. The two second openings 6 are also arranged opposite each other. The first openings 5 serve to stabilize the core component 1 and to facilitate the production of the core component 1. The second openings 6 serve to guide winding wire and/or connection elements in and out of the core component 1 and in particular the inner region 8.

An opening 5, 6 is delimited laterally in each case by the longitudinal edges 3*a* of two different members 3. Consequently, the openings 5, 6, in particular the side edges of the openings formed by the longitudinal edges 3*a*, are constructed to be rounded. The openings 5, 6 extend from the base plate 2 in a horizontal and vertical direction. The respective first opening 5 has a smaller horizontal extent than the respective second opening 6. In other words, the first opening 5 is smaller than the second opening 6. For example, the horizontal extent of the first opening 5 is ⅓ of the horizontal extent of the second opening 6.

The core component 1 and in particular the base plate 2 further has two recesses 7. The respective recess 7 is formed at the location of the second opening 6 in the base plate 2. The recess 7 has a rounded inner face 7*a*, as can be seen in FIG. 4. The recess 7 has an opening angle 10 of more than 30° and less than 50°. For example, the recess 7 has an opening angle 10 of 40°, preferably between 380 and 39°, in a particularly preferred manner 38.78°. The respective recess 7 serves to secure the core component 1 to a printed circuit board. In particular, the respective recess 7 serves to receive securing means, for example, pins, on the printed circuit board.

The core component 1 further has a centre piece or centre lug 4. The centre piece 4 is formed in the inner region 8 of the core component 1. The centre piece 4, the members 3 and the base plate 2 are preferably constructed in an integral manner.

A region between the centre piece 4 and the inner face 3*b* of the respective member 3 forms a winding space of the core component 1. In particular, the inner region 8 and the centre piece 4 are constructed in such a manner that a coil member can be introduced around the centre piece 4 with a winding wire.

The centre piece 4 has an oval shape. The centre piece 4 has a longitudinal axis 11 (see FIG. 4). The centre piece 4 has a transverse axis 12 (see FIG. 4). The longitudinal axis 11 and transverse axis 12 meet at a centre point 13 of the centre piece 4.

Preferably, the longitudinal axis 1 has a length which is from 1.1 to 1.5 times the length of the transverse axis 12. The longitudinal axis 11 has a length of less than 15 mm and more than 10 mm, for example, 12 mm. In a particularly preferred manner, the longitudinal axis 11 has a length of 11.3 mm. The transverse axis 12 has a length of less than 10 mm and more than 6 mm, for example, 8 mm. In a particularly preferred manner, the transverse axis 12 has a length of 8.1 mm.

The above-described first opening 5 of the core component 1 extends in a horizontal direction parallel with the longitudinal axis 11 of the centre piece 4. The above-described second opening 6 extends in a horizontal direction parallel with the transverse axis 12 of the centre piece 4.

As a result of the specific oval shaping of the centre piece 4, the inner region 8 and in particular the winding space are increased in comparison with conventional core components. Preferably, the winding space of the core component 1 has a surface-area of more than 50 $mm^2$, for example 55 $mm^2$, preferably 55.2 $mm^2$. Conventional core components, such as an RM8 core, have in contrast a winding space having a surface-area of less than 50 $mm^2$. A conventional RM8 core thus has a winding space having a surface-area of 48.95 $mm^2$.

As a result of the oval shape of the centre piece 4 and the inner region 8 (and consequently the winding space), the power loss of the core component 1 in comparison with conventional core components is further reduced since the core component 1 has a substantially larger effective magnetic cross-section than conventional core components. The above-described core component 1 has a minimum effective magnetic cross-section Ae(min)=72 $mm^2$. In contrast, a conventional RM8 core has a minimum effective magnetic cross-section Ae(min)=55 $mm^2$.

As a result of the use of the structural shape based on an X core (square basic shape, four openings), optimum use is made of the space available. Furthermore, the geometric shape of the core component 1 with the square base plate and the four members 3 leads to better shielding with respect to the EMC behavior. The fact that the winding contained in the core component 1 is better surrounded compared with conventional core components also contributes to this. In particular, the free spaces provided by the openings 5, 6 are significantly smaller than in conventional core components.

On the whole, a space-saving geometrically optimized and very effective component is provided and has an optimized EMC behavior.

The description of the aspects of subject-matter set out herein is not limited to the individual specific embodiments. Instead, the features of the individual embodiments—technically advantageous—can be freely combined with each other.

While this invention has been described with reference to illustrative embodiments, this description is not intended to be construed in a limiting sense. Various modifications and combinations of the illustrative embodiments, as well as other embodiments of the invention, will be apparent to persons skilled in the art upon reference to the description. It is therefore intended that the appended claims encompass any such modifications or embodiments.

What is claimed is:

1. A core component comprising:

a base plate;

a plurality of members arranged on corners of the base plate and delimiting an inner region of the core component;

a center piece located in the inner region and having an oval basic shape; and a plurality of openings comprising two first openings and two second openings, wherein the first openings and the second openings are arranged opposite each other around the base plate, wherein the first openings have a smaller extent in a horizontal direction than the second openings, wherein a respective member is formed in an asymmetrical manner around a respective corner of the base plate, wherein the respective member has two outer faces, which have a different extension along the base plate, wherein the base plate has at least one recess, and wherein the recess is located in the base plate at a location of a respective second opening.

2. The core component according to claim 1, wherein the inner region of the core component is oval.

3. The core component according to claim 1, wherein the core component has an effective magnetic cross-section greater than or equal to 72 $mm^2$.

4. The core component according to claim 1, wherein each respective member has an inner face facing the center piece, and wherein the inner face is rounded.

5. The core component according to claim 4, wherein the inner face is delimited by two longitudinal edges of the respective member extending from the base plate in a vertical direction, and wherein the longitudinal edges are rounded.

6. The core component according to claim 5, wherein a rounding of a respective longitudinal edge has a radius of more than 4 mm and less than 6 mm.

7. The core component according to claim 1, wherein an opening extends from the base plate in a vertical direction, and wherein the opening is located between two members.

8. The core component according to claim 1, wherein a respective first opening extends in the horizontal direction parallel with a longitudinal axis of the center piece, and wherein the respective second opening extends in the horizontal direction parallel with a transverse axis of the center piece.

9. The core component according to claim 1, wherein the recess has an opening angle, and wherein the opening angle is greater than 35° and less than 40°.

10. The core component according to claim 1, wherein the base plate has a square basic shape.

11. A core component comprising:

a base plate;

a plurality of members arranged on corners of the base plate and delimiting an inner region of the core component;

a center piece constructed in the inner region and having an oval basic shape; and a plurality of openings comprising two first openings and two second openings, wherein the first openings and the second openings are arranged opposite each other around the base plate, wherein the first openings have a smaller extent in a horizontal direction than the second openings, wherein a respective member is formed in an asymmetrical manner around a respective corner of the base plate, wherein the respective member has two outer faces, which have a different extension along the base plate, wherein a respective first opening extends in the horizontal direction parallel with a longitudinal axis of the center piece, and wherein a respective second opening extends in the horizontal direction parallel with a transverse axis of the center piece.

* * * * *